United States Patent [19]

Koponen et al.

[11] Patent Number: 4,566,946

[45] Date of Patent: Jan. 28, 1986

[54] TRANSFER ARRANGEMENT FOR GUIDING THE PAPER WEB FROM THE PRESS SECTION OF A PAPER MACHINE TO IT'S DRYING SECTION

[75] Inventors: Martti Koponen; Olli Tapio, both of Jyväskylä, Finland

[73] Assignee: Valmet OY, Finland

[21] Appl. No.: 546,925

[22] Filed: Oct. 31, 1983

[30] Foreign Application Priority Data

Nov. 2, 1982 [FI] Finland ..... 823742

[51] Int. Cl.[4] ..... D21F 3/04

[52] U.S. Cl. ..... 162/359; 162/360.1; 34/114; 34/116; 34/117

[58] Field of Search ..... 162/305, 306, 359, 360.1; 34/114, 116, 117

[56] References Cited

U.S. PATENT DOCUMENTS

| | | | |
|---|---|---|---|
| 2,448,295 | 8/1948 | Bratton | 162/360.1 |
| 2,618,205 | 11/1952 | Heys | 162/360.1 |
| 3,250,019 | 5/1966 | Beachler | 162/359 |
| 3,733,711 | 5/1973 | Haythornwaite | 34/114 |
| 4,014,740 | 3/1977 | Koponen | 162/359 |
| 4,086,131 | 4/1978 | Rempel et al. | 162/360.1 |
| 4,172,007 | 10/1979 | Kankaanpää162 | 359/ |
| 4,183,148 | 1/1980 | Koski et al. | 34/116 |

*Primary Examiner*—William F. Smith

*Attorney, Agent, or Firm*—Steinberg & Raskin

[57] ABSTRACT

In a paper making machine, transfer apparatus for guiding a paper web from the press section to the drying section includes a smoothing press including upper and lower smoothing press rolls wherein the web is passed from the press section to the smoothing nip either directly or guided by a guide roll. The lower smoothing press roll of the smoothing press is substantially situated at a position which is normally occupied by a so-called baby or lead-in cylinder of a conventional drying section and the drying wire of the drying section is guided over a sector of the lower smoothing roll which is of a size sufficiently large that the web is transferred onto the drying wire which then carries the web as a closed draw onto the first drying cylinder of the drying section and, preferably, to the subsequent drying cylinders as a so-called single-fabric draw.

17 Claims, 1 Drawing Figure

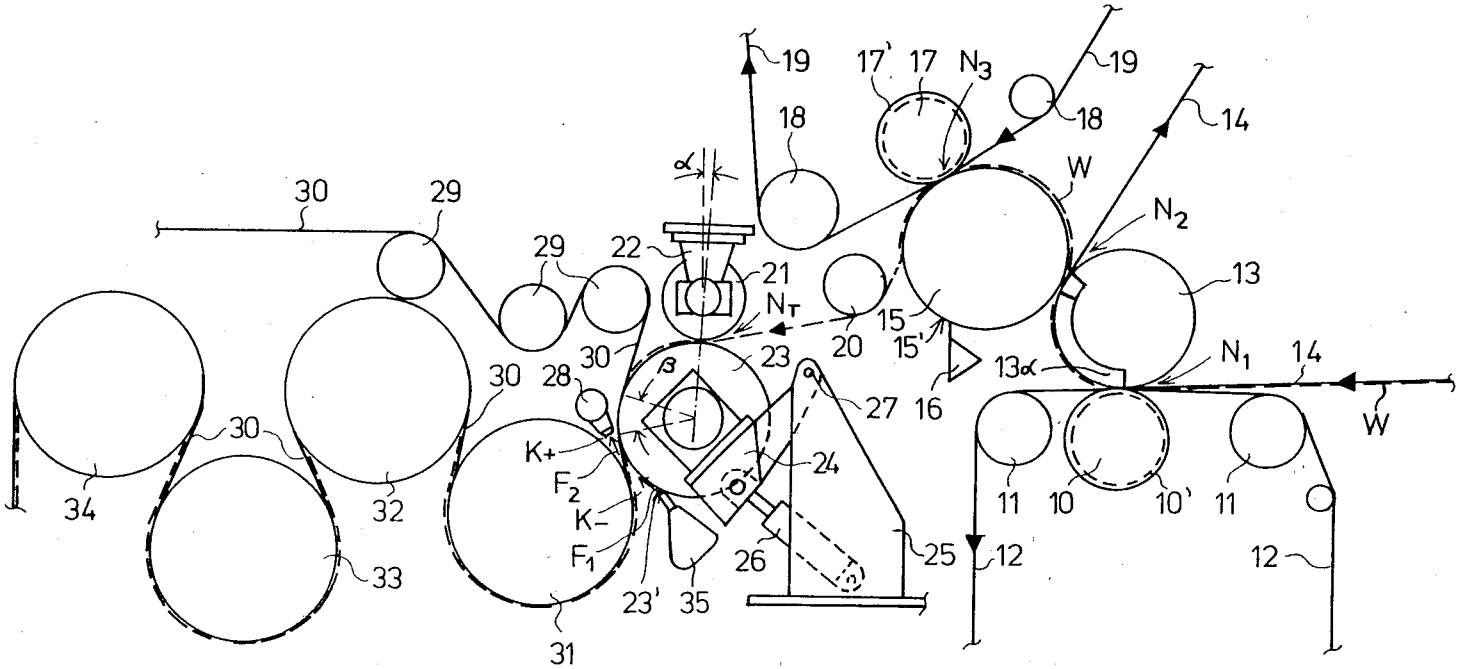
W
14
12
11
10'
10
13
N1
N2
N3
13a
16
15
15'
17
17'
18
19
20
21
22
23
23'
24
25
26
27
28
29
30
31
32
33
34
35
NT
F1
F2
K+
K-
α
β

TRANSFER ARRANGEMENT FOR GUIDING THE PAPER WEB FROM THE PRESS SECTION OF A PAPER MACHINE TO IT'S DRYING SECTION

BACKGROUND OF THE INVENTION

The present invention relates generally to paper making machines and, more particularly, to a transfer arrangement for guiding a paper web from the press section of a paper machine to it's drying section.

The provision of a smoothing press between the drying and press sections of a paper making machine is known. A smoothing press generally includes two press rolls which form between them a smoothing nip, the web being passed to the smoothing nip from the press section either directly or guided by a guide roll or the like.

A smoothing press is, as a rule, used in a fine-paper making machine after the press section in order to smooth the faces of the paper web. A smoothing nip is formed between two smooth-faced press rolls. In most cases, no fabrics are passed through the smoothing nip so that the web is in direct contact with the faces of the press rolls. An example of the type of roll used in a smoothing press is a roll whose mantle is formed of cast iron, the outer surface of which is coated with rubber.

In conventional arrangements wherein smoothing presses are utilized, the web is passed unsupported, i.e., as an open draw, from the press section into the smoothing press nip and from there the web is passed as an open draw, unsupported by a fabric, to the drying section. In this connection, the web is most commonly passed from the smoothing press nip onto a so-called baby cylinder or lead-in cylinder of the drying section. Such baby or lead-in cylinders are steam-heated drying cylinders, the effective drying capacity of which is relatively low due to the relatively small cover angle of the web on the baby cylinder. For this reason, these cylinders are generally not included in determining the effective number of drying cylinders in the drying section.

There is a considerable risk web breakage on the open draw of the web between the press section and the baby cylinder of the drying section and, in particular, on the open draw which exists after the smoothing press. Such web breakage often necessitates shutting down the paper machine for relatively long periods of time. The risk of web breakage which is particularly high in the case of thin paper webs is due to the fact that the web is still relatively weak and flexible after the press section so that web fluttering induced by air currents or other circumstances may result after the press section with resulting web breaks.

SUMMARY OF THE INVENTION

Accordingly, it is an object of the present invention to provide a new and improved transfer apparatus for guiding a paper web from the press section of a paper machine to the drying section.

Another object of the present invention is to provide a new and improved transfer apparatus for guiding the paper web from the press section to the drying section which utilizes a smoothing press and in which a closed draw of the web is provided.

Still another object of the present invention is to provide a new and improved transfer apparatus for guiding a paper web from the press section to the drying section which utilizes a smoothing press which provides a favorable closed draw of the web which additionally enables the omission or elimination of the baby or lead-in cylinder which, as noted above, is substantially ineffective in the drying of the web.

Briefly, in accordance with the present invention, these and other objects are attained by providing transfer apparatus in the form of a smoothing press including a smoothing nip formed between upper and lower smoothing press rolls to which the paper web is passed from the press section. The smoothing press is situated between the press and drying sections with the lower smoothing press roll being substantially situated at a position which is normally occupied by a lead-in or baby cylinder of a conventional drying section. The drying wire of the drying section is guided over a sector of the lower smoothing press roll, the sector covered by the drying wire having a size which is sufficiently large so that the web is transferred onto the drying wire whereupon the drying wire carries the web as a closed draw onto a first one of the drying cylinders of the drying section. The drying wire preferably carries the web as a so-called single-fabric draw onto subsequent drying cylinders.

DESCRIPTION OF THE DRAWINGS

A more complete appreciation of the present invention and many of the attendant advantages thereof will be readily understood by reference to the following detailed description when considered in connection with the accompanying drawing in which the sole FIGURE is a schematic side elevation view of transfer apparatus in accordance with the invention situated between the press and drying sections of a paper machine.

DESCRIPTION OF THE PREFERRED EMBODIMENTS

Referring now to the FIGURE, the illustrated preferred embodiment of the transfer apparatus in accordance with the invention is utilized in a paper machine the press section of which is a closed press section and, in particular, comprises a so-called Sym-Press press section, available from Valmet Oy of Finland. The paper web W is carried into the press section on the lower face of a fabric 14 which functions as a pick-up fabric as well as a press fabric in the first and second press nips $N_1$ and $N_2$ of the press section. Thus, the web W is picked up from the forming wire (not shown) and carried on the lower surface of the fabric 14 into the first press nip $N_1$. The first press nip $N_1$ is formed between a lower press roll 10 having a hollow face 10' and a suction roll 13. The first press nip $N_1$ is double felted, the pick-up felt 14 and a lower felt 12 guided by guide rolls 11 passing through the nip $N_1$. After the first press nip $N_1$, the web W remains attached to the fabric 14 and follows the suction roll 13 due to the suction zone 13α. The second press nip $N_2$ is formed between the suction roll 13 and a large diameter central roll 15 having a smooth surface 15' and which may comprise a granite roll or the like. The third press nip $N_3$ of the press section is formed between the central roll 15 and a press roll 17 having a hollow face 17'. A press felt 19 passes through the third press nip $N_3$ guided by guide rolls 18. A doctor 16 is situated beneath the central roll 15.

The web W adheres to the smooth surface 15' of the central roll 15 of the press section from which it is detached and, guided a guide roll 20, transferred to the smoothing press in accordance with the invention. The smoothing press includes an upper smoothing press roll 21 which is mounted on stationary bearing supports 22 and a lower smoothing press roll 23 having a diameter which is substantially larger than that of the upper smoothing press roll 21.

In accordance with the invention, the lower smoothing press roll 23 is substantially situated at a position which is normally occupied by a lead-in or baby cylinder of a conventional drying section. As noted above, such lead-in or baby cylinders are steam-heated cylinders whose drying capacity, however, remain quite low due to the small angle covered by the web.

The smoothing press rolls 21 and 23 form a smoothing press nip $N_T$ between them. Preferably, the smoothing press nip $N_T$ can be selectively opened when desired, e.g., when it is not required to pass the paper web through the smoothing press nip $N_T$. In this connection, the lower smoothing press roll 23 of the smoothing press is journaled in movable bearing supports 24 mounted to the paper machine frame 25 by pivot pins 27 so as to be articulated thereto. Appropriate power means such as hydraulic piston-cylinder arrangements 26 are provided between the bearing supports 24 and the frame 25 so that the lower smoothing press roll 23 can be pivoted to a lower position than that shown in the FIGURE to thereby open the smoothing press nip $N_T$ when desired. It is of course understood that either one of the upper and lower smoothing press rolls can be mounted so as to have a fixed axis of rotation with the other of the smoothing press rolls being mounted so that its axis of rotation is selectively movable so that the smoothing press nip can be opened and closed when desired.

The upper smoothing press roll 21 of the smoothing press is a smooth-faced roll while the lower smoothing press roll 23 preferably comprises a cast-iron mantle roll which is coated with a hard rubber.

The drying section situated after the smoothing press in the machine direction includes one or more drying cylinders 31–34 and a drying wire 30 passing between the drying cylinders in a conventional manner. In accordance with the invention, the drying wire 30 is guided by guide rolls 29 so that the drying wire 30 covers the lower smoothing press roll 23 over a sector designated $\beta$. The magnitude of the sector $\beta$ preferably is in the range of between about 10° to 60°, and most preferably is about 30°. The smoothing press nip $N_T$ is a substantially horizontal nip. In this connection it has been found to be preferable to position the smoothing press rolls such that a plane passing through the axes of the upper and lower smoothing press rolls forms a small angle $\alpha$ with a vertical plane which passes through the axis of one of the upper and lower smoothing press rolls. The magnitude of the angle $\alpha$ is preferably in the range of between about 5° to 20° and, most preferably, is about 10°.

The magnitude of the sector $\beta$ of the lower smoothing press roll covered by the drying wire 30 as described above is sufficient such that the web W will be transferred to the drying wire 30 so that the drying wire 30 will also function as a transfer wire 30 to carry the web W onto the first drying cylinder 31 in the drying section. The drying section includes, as is conventional, a lower row of drying cylinders including cylinders 31 and 33 and an upper row of drying cylinders including cylinders 32 and 34. The web W is carried on the outside face of the drying wire 30 as it travels over the first drying cylinder 31, i.e., the drying wire 30 is situated between the web and the drying cylinder 31, as is the case of the third drying cylinder 33 (and all subsequent lower cylinders) in the drying section. On the other hand, the web W is situated between the drying wire 30 and the surfaces of the upper cylinders, including second and fourth drying cylinders 32 and 34, in the drying section.

A first wedge-shaped space K+ is defined between the first drying cylinder 31 and the straight run of the drying wire by which the web is carried after the sector $\beta$. A positive or overpressure tends to be created in this first wedge-shaped space K+ during running of the machine as induced by the surface of roll 31 and by the wire 30. Such positive or overpressure has the detrimental effect of tending to detach the web from the drying wire 30 after the sector $\beta$. Correspondingly, a second wedge-shaped space K− is defined between the surface 23' of the lower smoothing press roll 23 and the web W carried on the drying wire 30 after the sector $\beta$. A negative or underpressure tends to be created in the second wedge-shaped space K− during machine run which also has the detrimental effect of tending to detach the web from the drying wire 30.

In order to reduce the possibility of web detachment due to the overpressure created in the first wedge-shaped space K+ as noted above, apparatus 28 are provided by means of which air is suctioned from the first wedge-shaped space K+, such suction being denoted by arrow $F_2$. Similarly, in order to reduce the possibility of web detachment from the drying wire 30 in the second wedge-shaped space K−, appropriate apparatus are provided for blowing air into the second wedge-shaped space to eliminate the pressure differential which would otherwise exist. In the illustrated embodiment, such air blowing apparatus is provided in conjunction with a doctor blade 35 which acts in operative relationship with surface 23' of the lower smoothing press roll 23. Thus, blow openings are provided in the doctor blade 35 through which air is blown as designated by arrow $F_1$ into the second wedge-shaped space K− in order to prevent a negative pressure from being generated to insure that the web W does not become detached from the drying wire 30 on the critical run after the sector $\beta$. It will be understood that the devices 28 and 35 which tend to equilibriate the pressure differentials in the wedge-shaped spaces are not always necessary if the web can be made to follow along with the drying wire 30 in a reliable manner after the sector $\beta$. However, in any case, a doctor 35 is generally required in connection with the lower roll 23 of the smoothing press and it has been found that the blowing of air can be favorably provided in connection with such doctor apparatus.

The speed of the drying wire 30 is preferably somewhat higher than the circumferential speed of the lower roll 23 of the smoothing press, such difference in speed being about 0.5%.

As noted above, if the smoothing press nip $N_T$ is not required, it can be opened by shifting the roll 23 to a lower position whereby the web W can run without nip contact over the roll 23.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper making machine including a press section followed in the machine direction by a drying section including a lower row of drying cylinders and an upper row of drying cylinders and a drying wire passing over said drying cylinders, said drying section not including a lead-in drying cylinder, transfer apparatus for guiding a paper web from the press section to the drying section, comprising:

a smoothing press including a smoothing nip formed between upper and lower smoothing press rolls to which the paper web is passed from the press section, said smoothing press being situated between the press and drying sections with said lower smoothing press roll being situated at a position which is normally occupied by a lead-in drying cylinder of a conventional drying section substantially in the upper row of drying cylinders;

first guide roll means for guiding said drying wire of the drying section over an elongated angular sector of said lower smoothing press roll, said elongated angular sector having a size sufficiently large that the web is transferred onto said drying wire, said drying wire carrying the web as a closed draw to said drying section onto a first one of said drying cylinders and between drying cylinders of said lower and upper rows of the drying section; and said upper and lower smoothing press rolls are smooth-faced press rolls, said lower smoothing press roll having a substantially larger diameter than that of said upper smoothing press roll, and wherein no fabric passes through said smoothing nip so that the web is in direct contact with the faces of said smoothing press rolls.

2. The combination of claim 1 further including second guide roll means for guiding the web from the press section to said smoothing nip.

3. The combination of claim 1 wherein said drying wire on which the web is carried and said first drying cylinder define a first wedge-shaped space between them in which an overpressure tends to be created during machine run which would tend to detach the web from the drying wire, and further including first means for substantially preventing an overpressure from being created in said first wedge-shaped space to prevent detachment of the web from the drying wire.

4. The combination of claim 3 wherein said first means are constituted by suction means.

5. The combination of claim 3 wherein said lower smoothing press roll of the smoothing press and the web carried on said drying wire define a second wedge-shaped space between them in which an underpressure tends to be created during machine run which would tend to detach the web from the drying wire, and further including second means for substantially preventing an underpressure from being created in said second wedge-shaped space to prevent detachment of the web from said drying wire.

6. The combination of claim 5 wherein said first and second means comprise means for generating air flow in said first and second wedge-shaped spaces.

7. The combination of claim 1 wherein said lower smoothing press roll of the smoothing press and the web carried in said drying wire define a wedge-shaped space between them in which an underpressure tends to be created during machine run which would tend to detach the web from the drying wire, and further including means for substantially preventing an underpressure from being created in said wedge-shaped space to prevent detachment of the web from said drying wire.

8. The combination of claim 7 wherein said means for substantially preventing an underpressure from being created in said wedge-shaped space include a doctor blade in operative relationship with the surface of said lower smoothing press roll and air blowing means provided in said doctor blade.

9. The combination of claim 1 further including first means for mounting one of said upper and lower smoothing press rolls on a fixed axis of rotation and second means for mounting the other one of said upper and lower smoothing press rolls on a selectively movable axis of rotation, whereby said smoothing nip can be selectively opened and closed.

10. The combination of claim 9 wherein said first mounting means includes stationary bearing support means for mounting said upper smoothing press roll and wherein said second mounting means includes movable bearing support means for mounting said lower smoothing press roll, said movable bearing support means being pivotally mounted so that the axis of rotation of said lower smoothing press roll is pivotable about a substantially horizontal axis, and power means for pivoting said movable bearing support means whereby said smoothing nip can be selectively opened and closed.

11. The combination of claim 1 wherein said lower smoothing press roll has a surface provided with a smooth rubber coating.

12. The combination of claim 1 wherein the size of said elongated sector of said lower smoothing press roll over which said drying wire is guided is in the range of between about 10° to 60°.

13. The combination of claim 12 wherein said sector size is about 30°.

14. The combination of claim 1 wherein said smoothing nip is a substantially horizontal nip.

15. The combination of claim 14 wherein a plane passing through the axes of said upper and lower smoothing press rolls and a vertical plane plane passing through the axis of one of said upper and lower smoothing press rolls form an angle in the range of between about 5° to 20°.

16. The combination of claim 1 wherein said drying section includes a plurality of drying cylinders and wherein said drying wire carries the web in a single-fabric draw from one drying cylinder to the next.

17. The combination of claim 1 wherein said upper smoothing press roll is a smooth-faced roll and said lower smoothing press roll has a surface provided with a smooth rubber coating.

* * * * *